United States Patent [19]

Resch

[11] Patent Number: 4,635,861

[45] Date of Patent: Jan. 13, 1987

[54] ROLLER MILL

[75] Inventor: Heinz Resch, Flawil, Switzerland

[73] Assignee: Gebruder Buhler AG, Uzwil, Switzerland

[21] Appl. No.: 699,019

[22] Filed: Feb. 7, 1985

[30] Foreign Application Priority Data

Feb. 11, 1984 [DE] Fed. Rep. of Germany ..... 3404932

[51] Int. Cl.[4] ..... B02C 4/32

[52] U.S. Cl. ..... 241/37; 72/240; 100/47; 100/158 R; 100/170; 241/231; 241/232; 241/234

[58] Field of Search ..... 100/158 R, 162 B, 47, 100/170; 72/240; 29/123; 241/37, 230–234

[56] References Cited

U.S. PATENT DOCUMENTS

| | | | |
|---|---|---|---|
| 2,762,295 | 9/1956 | Varga et al. | 241/230 |
| 3,078,747 | 2/1963 | Pearson . | |
| 3,097,591 | 7/1963 | Justus . | |
| 3,138,089 | 6/1964 | Shelton . | |
| 3,240,148 | 3/1966 | Varga . | |
| 3,445,070 | 5/1969 | Verdier | 241/231 X |
| 3,459,124 | 8/1969 | Notbohm | 100/47 X |
| 4,411,609 | 10/1983 | Yoshii et al. . | |

FOREIGN PATENT DOCUMENTS

| | | |
|---|---|---|
| 1028098 | 10/1950 | France . |
| 1273350 | 11/1960 | France . |

*Primary Examiner*—Mark Rosenbaum

*Attorney, Agent, or Firm*—Merchant, Gould, Smith, Edell, Welter & Schmidt

[57] ABSTRACT

A roller mill, in which the milling rollers are pressed together with high pressures, has a fluidic device for imparting the respective pressure. This fluidic device comprises piston-cylinder units and a pressure line for the fluid. In order to obtain a skewing of at least one roller in dependency upon the pressure exerted by the fluidic device, pressure sensitive means are interposed between the pressure line and a displacing device for the skewing angle. In this way, a pressure signal may be transferred to a converter for converting the pressure into a corresponding displacement stroke. Preferably, at least one roller has a basic camber or crown which corresponds to a pressure within a lower range of the occurring pressures.

26 Claims, 6 Drawing Figures

ROLLER MILL

This invention relates to a roller mill having at least two milling rollers and a device for imparting pressure to at least one of the rollers to press both against each other. Furthermore, a displacing device is provided to move at least one of the rollers out of parallel with their axes of rotation as a function of the pressure exerted by the pressure imparting device, which pressure may either vary unintentionally (e.g. by heat) or intentionally (e.g., by actuating a pressure control device).

BACKGROUND OF THE INVENTION

Roller mills having a displacing mechanism for skewing at least one milling roller relative to the other have already been proposed occasionally in the literature in order to avoid the necessity of cambering or crowning the rollers over their length. Examples of such constructions may be found in the French Pat. Nos. 1,028,098 and 1,273,350 as well as in the U.S. Pat. No. 2,762,295, whereas with respect to rollers with a real camber or crown, it is referred to U.S. Pat. Nos. 3,078,747, 3,097,591 or 3,138,089.

Mostly, roller mills with a skew are operated with a predetermined desired pressure corresponding to a predetermined skew of the rotational axis or, in roller mills without such a skewing device, with a predetermined camber or crown. Therefore, the known roller mills according to the above-mentioned references were only provided with a manual adjusting device for the skew whereby the respective foreman could adjust the angle of the skew by means of a screw-socket wrench.

Of course, this is inconvenient in roller mills in which the pressure is adjustable, e.g. in calenders for textile material. Thus, for such an application, it has been proposed in the U.S. Pat. No. 3,240,148 to mount on a common shaft either a pressure eccentric for manually adjusting the roller pressure and a displacing eccentric for skewing the axis of one roller. It will be understood that such a construction will only be applicable for relative small operational pressures, as may occur in textile calenders. However, if—for controlling purposes or for adjusting the mill to grind different products—the pressure has to be changed in such roller mills where pressures of several hundred kilograms or even of several tons are applied, the prior solution is no longer feasible.

SUMMARY OF THE INVENTION

It is an object of the invention to create a practical solution for automatically adjusting the skewing angle as a function of the pressure (or vice-versa) in a roller mill in which the pressure exerted by the rollers amounts to several hundreds of kilograms, particularly more than one ton, e.g. more than 4 tons.

This object is attained in accordance with the invention in that the pressure imparting device—particularly for the treatment by grinding and homogenizing viscous products, such as chocolate masses, printing dyes or the like—is formed as a fluidic biasing device having a piston, cylinder and a pressure line for a fluid, as known per se, that a pressure transfer or device for transferring a pressure signal is interposed between the pressure line and the displacing device, and that the displacing device comprises a converter for converting the pressure signal into a corresponding displacement stroke. In such a roller mill, the above-mentioned pressures are suitably realized in that the pressure imparting device is formed by a hydraulic biasing device, as is known per se.

BRIEF DESCRIPTION OF THE DRAWINGS

Further details of the invention will become apparent from the following description of embodiments schematically illustrated in drawings.

DETAILED DESCRIPTION OF THE DRAWINGS

Figure 1:
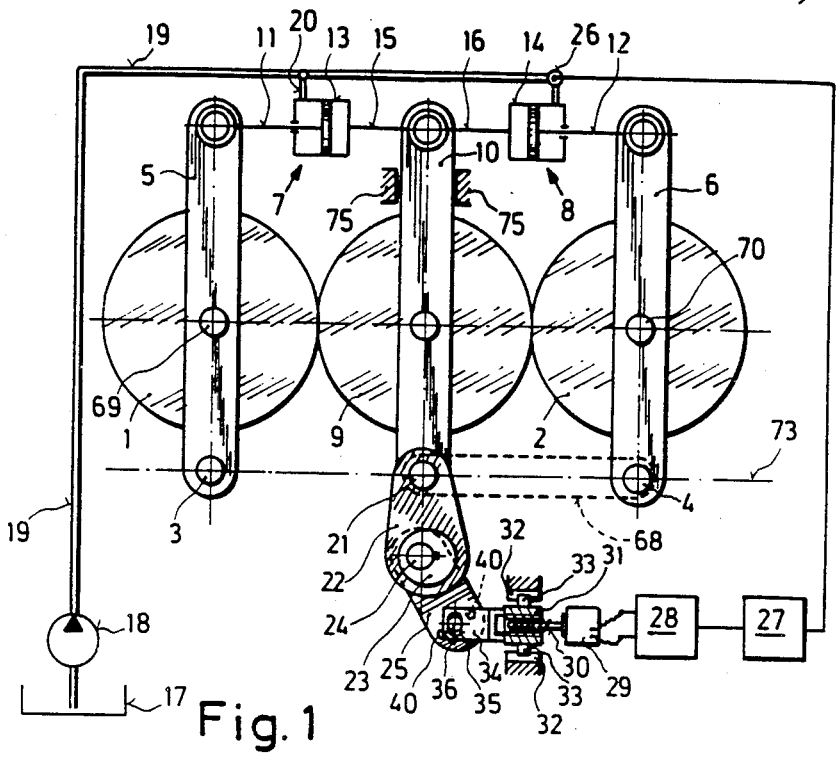
FIG. 1 is a side view of a roller mill according to a first embodiment with three milling rollers.

In a roller mill with three milling rollers 1, 2 and 9, both outer rollers 1, 2 are supported by levers 5 and 6, each being pivoted on a rigid axis 3 or 4, and in bearings 69, 70. Both outer rollers 1, 2 are clamped against the intermediate roller 9, which is supported by a lever 10, by means of fluidic piston-cylinder units 7, 8 through the levers 5, 6. The connection between the levers 5, 6 and 10 and the units 7 and 8 is only schematically illustrated by a line, but it is to be understood that the connection between the outer levers 5, 6 and the respective piston-cylinder unit 7 or 8 is effected through the respective piston rod 11 or 12 hinged to the lever 5 or 6, whereas the respective cylinder 13 or 14 is connected to the intermediate lever 10 by an associated rod member 15 or 16 hinged to the lever 10.

Pressure fluid, especially a hydraulic medium, is supplied to the piston-cylinder units 7, 8 from a tank 17 by means of a pump 18 being connected to a pressure line 19. The pressure line 19 discharges on the one hand through a branch line 20 into the cylinder 13 of the unit 7, and on the other hand directly into the cylinder 14 of the unit 18.

Whereas both outer levers 5, 6 are pivoted upon stationary axes' 3 and 4, the lever 10 with its axis 21 is slidable in vertical direction. In principle, for this vertical displacement there is a certain guidance which results from the two outer rollers 1, 2 engaging the outer surface of the intermediate roller 9, but it is additionally possible to provide a guiding arrangement (not shown), e.g. a linear guide or a guiding slot in a support frame or the like for the rollers. This is particularly suitable, if the two outer rollers 1, 2 are pressed against the intermediate roller 9, as in the embodiment shown. It is, however, also possible to have one of the outer rollers, e.g. the roller 2, stationary supported, in which case it is simpler and more favorable in construction, if a guide link 68 (shown in dotted lines) is hinged on the stationary axis 4 of the lever 6 bearing the roller 2. This guide link 68 pivots preferably about a horizontal plane 73 intersecting its hinge axis 4 and being substantially perpendicular to the displacing direction of the lever 10 and the roller 9, since in this way there is only a small divergence from a linear motion. In principle, the link 68 may also be arranged at the top of the levers 6 and 10, in case the units 7 and 8 act upon the bottom end, or (for instance in case the roller 2 is stationary) the link 68 may have a hinge bearing that is independent from the lever 6 and the related support frame (not shown). However, the common use of the bearing 4 is simpler on the one hand, and on the other hand it has been found favorable, when the length of the link 68 corresponds substantially to the distance to the adjacent roller, i.e. substantially to the diameter of one roller. In this way, an effect, as already described in the French Pat. No. 1,273,350, is achieved by a simpler construction.

For driving purposes to achieve this vertical displacement, a suspension link 22 is articulated upon an axis 21 and embraces a skew eccentric 23 with its lower end. By using an eccentric, the axial width of which may be suitably selected according to the constructive requirements, the pressure may be transferred to a relative large surface, so as to avoid too high surface pressures, as would occur by the use of non-circular cams, for example.

The skew eccentric 23 is mounted on a stationarily supported shaft 24 extending parallel to the intermediate roller 9 and bearing a similar skew eccentric on its opposite end (not shown) for displacing there a lever that corresponds to the lever 10. However, the arrangement is such that the eccentricity of both skew eccentrics is shifted or turned by 180°, as is known per se, in such a manner that with a displacement of the intermediate roller 9 in upward direction on one of its sides, it is displaced in downward direction on the other side. In this way, a skewing of the intermediate roller 9 relative to the two outer rollers 1, 2 is achieved about a skewing axis extending through the middle of the length of the rollers. This arrangement corresponds to conventional constructions and is, thus, not represented in detail in the drawings.

Although, it is in principle possible to drive the shaft 24 through a drive pinion, a crank drive with a crank 25 is particularly advantageous, as will be described later. In order to control the displacement for skewing the roller 9 as a function of the pressure exerted by the units 7 and 8 onto the rollers 1, 2 and 9, an electric pressure sensor 26 is provided within the pressure line 19. The output signal of this electric pressure or sensor 26 is supplied to a control stage 27 providing a displacement signal for a motor control stage 28 on account of a comparison of the output signal of the sensor 26 with a nominal value which may be adjustable, if desired. The related motor 29 may be of any desired type (in which case a closed-loop control is suitable), but is preferably a stepping motor, so that the displacement of the eccentrics 23 (only one of which is shown) mounted on the shaft 24 depends upon the direction of rotation of the motor 29 and upon the number of pulses supplied to it. Therefore, the position of the crank 25 is always determined within the control system without the necessity of a position transducer for indicating the position of the crank 25 to the control stage 27, which position transducer would be needed, if a closed-loop control should be arranged instead a mere open-loop control.

Motor controls of this type are known for other purposes, e.g. from U.S. Pat. No. 4,411,609, where a controller and a motor drive circuit are provided in a similar way, as it is the case with the stages 27 and 28.

The rotor of the stepping motor 29 supports a threaded spindle 30 screwed into a nut 31. This nut is prevented to rotate by laterally extending wings 33 engaging stationary axial guides 32. A push rod 34 is connected with one end to the nut 31 and with the other end to a crank pin 36 on the crank 25 which is inserted into a slot hole 35 extending across the motional direction of the push rod 34. From the further description, it will become apparent that a servo-amplifier 48 to 52 may be interposed between the stepping motor 29 and the crank 25, as shown in FIG. 3, although a direct driving connection would theoretically also be possible.

Figure 2:
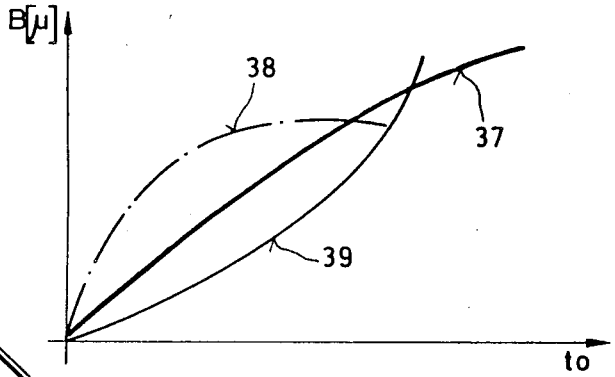
FIG. 2 shows a diagramm for illustrating the interrelation between skewing angle (or camber of the roller) and pressure.

In FIG. 2, a diagram is shown, illustrating the interrelation between the height B in microns of the camber necessary in itself, and to be replaced at least in part by the skewing of the axis of rotation of the displaceable roller, relative to the applied pressure in tons (to). If the optimum relation is indicated by a curve 37, the displacement of the intermediate roller 9 (FIG. 1) corresponds indeed by no means to the ideal of the curve 37 (the relationship between the camber and the pressure is a non-linear one) on account of the use of the skew eccentric 23 prefered because of the favorable surface pressure to be achieved, but instead follows a curve 38 marked in dash-dotted lines. In case, this deviation is not acceptable, care should be taken for a compensation.

This may either be done by providing electronic compensation members within the control stage 27, this compensation members being formed, for example, by diodes or other components having a non-linear characteristic, as is usual in photo control circuits; or—additionally or alternatively—the drive of the shaft 24 may be effected via the crank 25, as described above in connection with FIG. 1, arranged with respect to the skew eccentric 23 in such a manner that a displacement will be achieved in accordance with a curve 39 of FIG. 2, resulting from a linear displacing motion by the displacing motor 29 on account of the sinusoidal motion of the crank pin 36. In this way, the bulge of the dashdotted curve 38 is substantially compensated. In order to realize in this connection an adjusting facility, either the angular position of the crank 25 (FIG. 1) may be adjustable with respect to the skew eccentric 23, or a plurality of mounting holes 40 for the crank pin 36 are provided.

Figure 3:
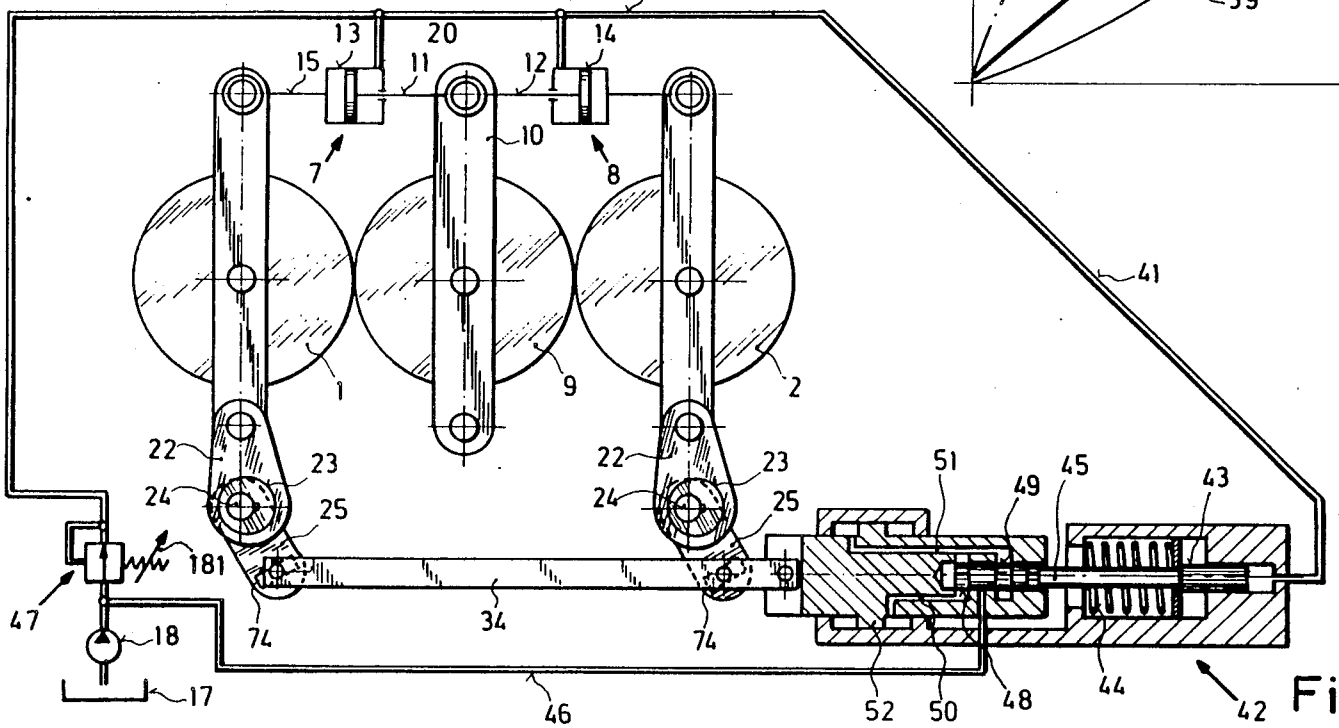
FIG. 3 shows a modification of the embodiment of FIG. 1.

For transferring a pressure signal corresponding to the pressure within the pressure line 19, it is not always necessary to transduce the pressure into electric signals, as in FIG. 1, but it is equally possible to connect the pressure line 19 directly to a connection line 41 leading to a converter unit 42, as in FIG. 3, which solution is preferred. In this case, a plunger 43 is directly biased by the pressure transferred by the connection line 19 and moves accordingly against the pressure of a spring 44. Since the opposing force of the spring 44 thereby increases, the plunger 43 will take its respective position where an equilibrium between the pressure signal from the pressure line 19 and the counter-pressure of the spring 44 will be attained. Instead of a spring 44, a spring action may also be effected by a gas to be compressed, by a magnetic counter-force or the like, however, the use of the spring 44 is particularly recommendable because of its linear characteristic by which the pressure within the pressure line 19 is converted into a linear stroke. Nevertheless, it should be pointed out, that, in some cases, a non-linear pressure converter may be provided just for compensation purposes discussed above in connection with FIG. 2.

The plunger 43 is connected to a plunger rod 45 that is formed at its left end (with respect to FIG. 3) as a control member of a servo-amplifier known per se which is connected directly to the pressure pump 18 through a line 46, whereas a pressure-reducing valve 47 is interposed within the path to the pressure line 19. In this way, the plunger rod 45 controls the flow of hydraulic medium from the line 46 through channels 50 and 51 to the respective side of a servo-plunger 52 by its control edges 48, 49 of enlarged diameter, whereby the servo-plunger 52 is displaced with respect to the plunger rod 45 until it has reached the position shown in FIG. 3 in which both channels 50, 51 are closed against the line 46. The displacement of the servo-plunger 52 is then transferred to the crank 25 in a similar way, as described above in connection with FIG. 1. Also in this case, an adjusting facility is suitably provided within a slot 74 which extend across the displacement path of the push rod 34.

Contrary to FIG. 1, in the embodiment of FIG. 3 the intermediate roller 9 is stationary, whereas the levers 5, 6 are displaceable in vertical direction by skew eccentrics 23. In principle, a displacement would also be possible by means of a single common eccentric 23 acting upon a linearily guided support, but the arrangement shown offers the facility of a separate adjustment of the two levers 5, 6 and makes also the expensive linear guidance unnecessary. The arrangement illustrated in FIG. 3 in particularly suited to be applied in roller mills with five milling rollers in which case two further rollers are respectively arranged at the sides of the rollers 1 and 2. It should be noted, however, that for skewing purpose it would be equally possible to displace two adjacent rollers in counter-sense so that the displacement of each of the adjacent rollers may be bisected.

Figure 4:
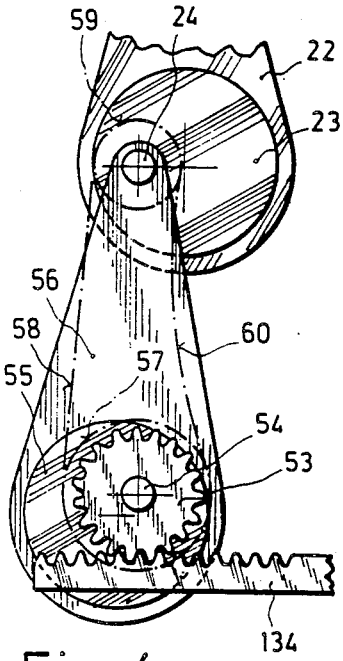
FIG. 4 and FIG. 5 illustrate variations of the displacing device.
Figure 5:
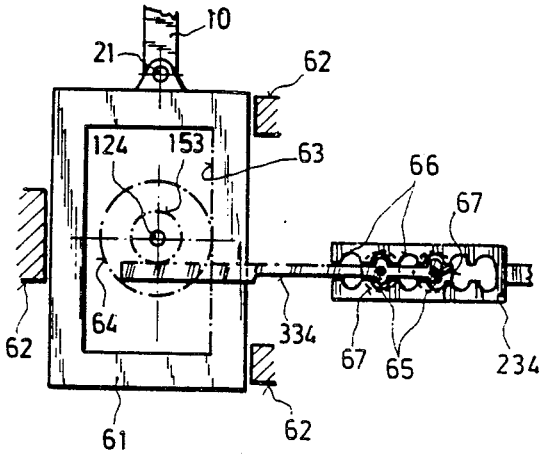

For the displacement drive, numerous different arrangements may be imagined, examples of which being shown in FIGS. 4 and 5. Thus, FIG. 4 shows a an arrangement in which a rod 134, corresponding in its function to the rod 34 in FIG. 1, is formed as a rack, the teeth of which being in engagement with a pinion 53 on a shaft 54 of a displacing eccentric 55. The displacing eccentric 55 is embraced by a connecting rod 56 bearing the shaft 24 on its top. The shaft 24 is driven by a sprocket 57 mounted on the shaft 54, said sprocket 57 being connected by a chain 58 to another sprocket 59 wedged on the shaft 24. If desired, a tension roller (not shown) for the chain may be located at 60.

It is clear, that by driving the rack 134 either electrically as in FIG. 1 or by a fluidic drive according to FIG. 3, the curves of the two eccentrics 23 and 55 are superimposed, so that a resultant motion will be achieved. But it will also be understood, that the resulting compensation may easier be attained by means of a crank 25.

It should be noted, that also lifting cylinders may be directly controlled at both ends of the roller 9 by servo-amplifiers, such as the amplifier comprising elements 48 to 52 of FIG. 3, in which case only care should be taken that the displacement of these lifting cylinders at both ends of the roller 9 should be effected in opposite directions. Such an arrangement may be particularly of advantage, if for example more than three rollers are used and should be skewed relative to each other, especially in a roller mill with at least four rollers. Such an arrangement would, in principle, correspond to FIG. 6 which will be described later.

Another suitable displacing mechanism is shown in FIG. 5 where the supporting lever 10 for the shaft of the roller 9 (vide FIGS. 1 and 3) is mounted on a frame 61. This frame 61 is vertically displaceable by means of sliding guides 62 and has a toothed rack 63 on one of its sides meshing with a pinion 64 mounted on a stationary shaft 124. On the other end of the roller 9, the arrangement is substantially the same, with the exception, however, that there the pinion which corresponds to the pinion 64 does not engage a rack on the right side of the frame 61 (with respect to FIG. 5), but meshes with a rack on the left side of the frame provided there. Thus, when the shaft 124 is driven, which extends parallel to the roller 9, the frames 61 on both ends of the roller 9 move in opposite directions.

According to this embodiment, the driving rod may consist of two parts 234, 334 joined together, the rack 334 of which having nodules or thickenings 65 selectively insertable into different recesses of the rod 234 whereafter both rod parts 234 and 334 are interconnected by fixing screws 67. However, in this way, only the height of the "camber" (which is replaced at least in part by the skewing) can be adjusted, whereas the course of the displacement characteristics cannot be influenced.

In order to realize the compensation described with reference to FIG. 2, it is necessary, of course, that the displacment stroke transmitted to the bearing of the respective roller to be skewed is in a certain relationship to the compensating motion. For example, a too large stroke of the crank 25 itself or provoked by the eccentric 55 would lead to a too flat and long compensation curve. On the other hand, the stroke of the displacement in height of the roller to be skewed depends not only upon the pressure applied, but also upon the length of the bearing levers, i.e. upon the distance between the center of the rollers 1, 2 or 9 and the point of application of the pressure at the top. In practice, a good compensation is attained, if the relationship between the stroke of the displacement of the respective bearing lever 10 (in FIG. 1) or 5, 6 (in FIG. 3) and the length of the crank is between 1:3 and 1:5.

It is known that the actual curve of "camber" resulting from skewing does not exactly meet the mathematical conditions of a real cambering or crowning. This may be one of the reasons, why heretofore a skewing has been realized rather rarely and moreover, only for small roller pressures. On the other hand, a crown grinded on a roller cannot be adapted to different pressures, so that, particularly with large pressure ranges, allowance has to be made for a certain deviation from the ideal shape.

One remedy in this dilemma could consist, in a roller mill having at least two milling rollers and a pressure imparting device for imparting pressure to at least one roller against the other as well as a displacing device for skewing the rollers relative to each other, in that at least one of the rollers 1, 2 or 9 to be skewed relative to the others has additionally a camber or crown, as known per se, which corresponds substantially to a pressure within the lower portion of the total range of pressure used in the roller mill. Thereby, also with large ranges of adjustment of the pressure, the deviations are minimized, because then there is a basic camber for the lower range of pressure, i.e. for the range below the half total range of adjustment of the pressure, preferably below a third of the total pressure range, and especially just calculated for the minimum pressure. Higher pressures are then compensated by skewing the axis of at least one roller. In this way, the basic camber may be realized in such a way that the mathematical deviation resulting from skewing the axis is compensated at least in part (preferably about by a half).

It has been found that an additional advantage is achieved by applying such a combination of a basic camber with a skewing of the rollers just in embodiments substantially corresponding to the embodiments described above. By frictional influences, namely, an undesired hysteresis of the displacement may occur, and since the displacement depends upon the pressure, this hysteresis is the greater the lower the pressure in which, on the one hand, biases the rollers 1, 2 and 9 against each other, and on the other hand could overcome the resistance by friction. The theoretical fault or deviation provoked by this hysteresis may even substantially be greater, than the above-mentioned mathematical difference between real camber and skewing. However, by providing a basic camber, that corresponds to a pressure in the lower range of pressure, in addition to the skew displacement of the axis of rotation of at least one roller 1, 2 or 9, the hysteresis is just in that range of no importance, in which it were the greatest in itself.

The above-mentioned basic camber may be provided on at least one of the rollers 1, 2 and 9, but is preferably present on at least that roller, which is displaced for skewing purposes, i.e. in the case of FIG. 1 on the roller 9, in the case of FIG. 3 on the rollers 1 and 2, particularly if it is the question of a roller mill with five milling rollers, are already mentioned. Suitably, all rollers have the basic camber of crowning, as described, which camber, of course, is not necessarily equal for all rollers and will particularly differ on the intermediate roller 9 (or rollers) from that of the marginal rollers 1 and 2.

In a practical realization, the total adjustment range of the pressure may have a relationship in the order of 1:6 between minimum pressure and maximum pressure. Supposing now that the minimum pressure be 1, the basic camber has to be established (and calculated in known manner) to meet a pressure of 3 in maximum, whereby, in practice, the pressure which forms the basis for the calculation will be substantially lower. For example, the pressure used for the calculation of the basic camber may be selected within the range of 1,5 to 2, or amounts even 1.

It shall be understood that the application of a basic camber in addition to the skewing of at least one roller is independent upon the question, whether the hydraulic pressure is converted into a displacement stroke for skewing the rotational axis of a roller, in the above-described sense. To the contrary, the combination with a basic camber is also of advantage, if a mere mechanical skewing according to the prior art is used.

Figure 6:
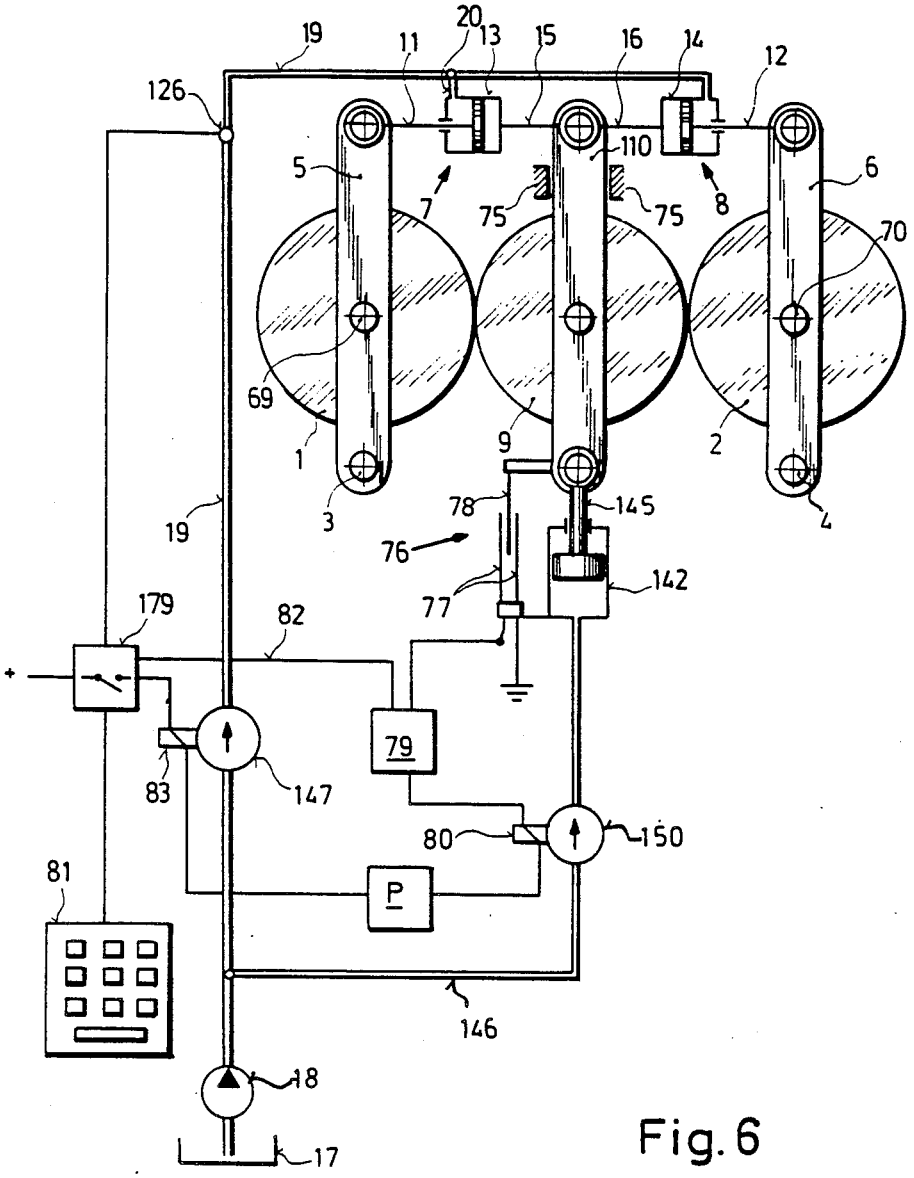
FIG. 6 represents a further embodiment.

FIG. 6 illustrates that only a mere open-loop control may be used for adjusting the skew of the roller 9 with respect to stationary rollers 1 and 2, but also a closed-loop control may be applied. As above, parts of the same function have the same numerals, as in the Figures described above, in case, however, with a hundred in addition.

In accordance with FIG. 6, a bearing support 110 is pivoted on a piston rod 145 of a hydraulic lifting unit 142 and is vertically movable (with respect to FIG. 6) and guided in its motion by sliding guides 75. The unit 142 is connected to the pump 18 through a line 146. Within this line 146, a solenoid valve 150 to be electrically controlled is provided and controls the flow of hydraulic fluid to the unit 142.

A position transducer 76 is connected to the bearing support 110 of the roller 9 and may be of any desired construction, but comprises in the embodiment shown two stationary condenser plates 77 (e.g. connected to the unit 142), between with a diaphragm plate 78 immerses which is connected to the displaceable bearing support 110. Therefore, a corresponding signal is obtained as a function of the actual position of the bearing support 110 at the output of the position transducer 76, this output signal being supplied to a control circuit 79.

The control circuit 79 represents, however, only one portion of a control system which comprises also a second control circuit 179. It is to be understood, that in cases both control circuits 79 and 179 may be combined to an integral unit. Since the control circuit 179 is connected to an input equipment 81 for a nominal value of the pressure, e.g. formed by a keyboard, suitably a connection line 82 to the control circuit 79 is provided in order to transmit a corresponding signal. In case, this connection line 82 may be formed as a data bus through which also an answer-back signal from the circuit 79 to the circuit 179 may be transmitted, if necessary.

In each case, a control signal for a solenoid 80 of the solenoid valve 150 is produced at the output of the control circuit 79, said signal being, in case, also supplied through a proportional link P to a solenoid 83 of a controllable valve 147 provided in the pressure line 19. However, the valve 147 may also be replaced by a simple pressure-reducing valve 47 according to FIG. 3, the adjustment being defined by an adjusting device 181 or an input equipment of any type desired. The solenoid 83 is also connected to the control circuit 179 connecting it to a source of voltage in dependency upon the nominal value signal, on the one hand, received from the input equipment 81, and on account of the output signal of a pressure transducer 126 in the pressure line 19 on the other hand.

I claim:

1. A roller mill, comprising:

at least first and second milling rollers;

first bearing means defining a first axis of rotation for said first milling roller;

second bearing means defining a second axis of rotation for said second milling roller;

means for supporting opposite ends of at least one of said first and second bearing means for movement so that the axes of rotation of said milling rollers are movable into and out of parallel with each other;

pressure imparting means to press said milling rollers together, said pressure imparting means comprising fluidic actuating means including piston-cylinder means, a source of pressurized fluid, and transfer means for said fluid from said source to said piston-cylinder means; and displacing means for automatically displacing the ends of at least one of said bearing means in opposite directions simultaneously to skew said first and second axes of rotation out of parallel, said displacing means comprising converter means for converting the pressure exerted by said pressure imparting means into a corresponding stroke of displacement; and connecting means interconnecting said pressure imparting means and said displacing means to make the amount of skew dependent upon the pressure exerted by said pressure imparting means, said connecting means including pressure transfer means connected to said pressure imparting means to transfer a signal corresponding to the pressure exerted, said pressure transfer means being also connected to said converter means.

2. A roller mill as claimed in claim 1, wherein said fluid is a hydraulic fluid.

3. A roller mill as claimed in claim 2, wherein said pressure transfer means comprise a connecting line between said transfer means and said converter means; the displacing means including a displacing mechanism; and the converter means comprising plunger means exposed to the pressure from said connecting line and being displaceable under this pressure;

rod means connected to said plunger means and to said displacing mechanism; and counter-biasing means for exerting a counter-force against the pressure from said connecting line to said plunger means, said counter-force increasing with the amount of displacement of said plunger means.

4. A roller mill as claimed in claim 3, wherein said counter-biasing means comprises a spring.

5. A roller mill as claimed in claim 3, further comprising servo-valve means for amplifying the force exerted by said rod means, said servo-valve means being interconnected between said rod means and said displacing mechanism.

6. A roller mill as claimed in claim 3, wherein said displacing mechanism comprises skew eccentric means to adjust at least one of said axis out of parallelity to each other said skew eccentric means being rotable about an axis of rotation being eccentric to their circumference and providing a certain motion characteristic; and compensation means to convert said motion characteristic into a desired displacement characteristic for said at least one axis of rotation.

7. A roller mill as claimed in claim 6, wherein said compensation means are interposed between said rod means and said skew eccentric means.

8. A roller mill as claimed in claim 6, wherein said compensation means comprise drive means rotatable about an axis.

9. A roller mill as claimed in claim 8, wherein said drive means comprise crank means.

10. A roller mill as claimed in claim 8, wherein said drive means and said skew eccentric means have a common axis of rotation.

11. A roller mill as claimed in claim 6, further comprising adjusting means for adjusting the compensation of said motion characteristic.

12. A roller mill as claimed in claim 1, further comprising at least a third milling roller, said at least first, second and third milling rollers being arranged one after the other, said displacing means being connected to one of said milling rollers interposed between two other milling rollers.

13. A roller mill as claimed in claim 1, further comprising guide means for linearly guiding the at least one bearing means to be displaced by said displacing means.

14. A roller mill as claimed in claim 1, further comprising link means hinged about an axis for guiding the at least one bearing means to be displaced by said displacing means.

15. A roller mill as claimed in claim 14, wherein said first and second bearing means comprise lever means, each being pivoted about an axis, said link means being rotatably connected to at least one of said pivoting axis.

16. A roller mill as claimed in claim 15, wherein said hinge axis is common with one axis of one of said bearing means.

17. A roller mill as claimed in claim 16, wherein said hinge axis is common with said pivoting axis.

18. A roller mill as claimed in claim 14, wherein said link means are hinged to move about a plane substantially normal to the direction of displacement of said guided bearing means.

19. A roller mill, comprising in combination:

at least first and second milling rollers each having a peripheral surface of predetermined length;

first bearing means defining a first axis of rotation for said first milling roller;

second bearing means defining a second axis of rotation for said second milling roller;

means for supporting opposite ends of at least one of said first and second bearing means for movement so that the axes of rotation cf said milling rollers are movable into and out of parallel with each other;

fluidic pressure imparting means to press said milling rollers together;

varying means for adjusting the pressure exerted by said pressure imparting means between a lower range of pressure including a minimum pressure, and a higher range of pressure; and displacing means for automatically displacing the ends of at least one of said bearing means in opposite directions simultaneously to skew said first and second axes of rotation out of parallel responsive to the pressure exerted on said rollers by said pressure imparting means;

at least one of the peripheral surfaces of said rollers having a camber corresponding substantially to said lower range of pressure.

20. A roller mill as claimed in claim 19, wherein said camber is provided on at least that milling roller which is displaceable through its bearing means by said displacing means.

21. A roller mill as claimed in claim 20, wherein all milling rollers have a cambered peripheral surface.

22. A roller mill as claimed in claim 19, wherein said camber corresponds substantially to said minimum pressure.

23. A roller mill as claimed in claim 1, further including:

electric control means for providing a nominal signal for the adjustment of both said pressure imparting means and said displacing means.

24. A roller mill, comprising:

a plurality of milling rollers rotatable about generally parallel axes;

means for fluidly biasing said rollers together under a predetermined fluidic pressure;

means for supporting one of said rollers for transverse displacement between parallel and skewed positions relative to the other roller;

a rotatable control shaft;

a pair of skew eccentrics secured in laterally spaced-apart relationship to said control shaft, said eccentrics being oriented 180 degrees out of phase relative to each other;

means including links coupled between said eccentrics and opposite ends of said one roller; and means responsive to the applied fluidic pressure between said rollers for automatically actuating said control shaft in order to displace opposite ends of said one roller in opposite directions simultaneously to adjust skew and maintain substantially uniform pressure distribution along said rollers.

25. The roller mill of claim 24, wherein said automatic actuating means comprises:

means for sensing the applied fluidic pressure biasing said rollers together and generating a pressure signal;

control means for converting the pressure signal into a corresponding displacement signal;

a crank secured to said control shaft; and a stepping motor responsive to said control means, said stepping motor including a rotor drivingly connected to said crank for effecting controlled automatic actuation thereof.

26. The roller mill of claim 24, wherein said automatic actuating means comprises:

a servo-amplifier including a movable plunger therein, said plunger being biased in one direction by the applied fluidic pressure between said rollers;

a crank secured to said control shaft, said crank being connected to the plunger in said servo-amplifier; and spring means for normally biasing the plunger in the opposite direction.

* * * * *